US006547556B2

(12) United States Patent
Crafton et al.

(10) Patent No.: US 6,547,556 B2
(45) **Date of Patent: *Apr. 15, 2003**

(54) COMBINATION CONDUCTION/CONVECTION FURNACE

(75) Inventors: Scott P. Crafton, Marietta, GA (US); James L. Lewis, Jr., Kennesaw, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/036,575

(22) Filed: Dec. 21, 2001

(65) Prior Publication Data

US 2002/0058224 A1 May 16, 2002

Related U.S. Application Data

(63) Continuation of application No. 09/464,229, filed on Dec. 15, 1999, now Pat. No. 6,336,809, which is a continuation-in-part of application No. 09/313,111, filed on May 17, 1999, now Pat. No. 6,217,317.

(60) Provisional application No. 60/112,400, filed on Dec. 15, 1998.

(51) Int. Cl.[7] ..... F27B 9/14

(52) U.S. Cl. ..... 432/124; 432/128; 432/132; 432/171; 164/131

(58) Field of Search ..... 432/124, 128, 432/129, 130, 132, 133, 163, 164, 166, 171, 207; 164/5, 131, 132

(56) References Cited

U.S. PATENT DOCUMENTS

| | | | | |
|---|---|---|---|---|
| 2,385,962 | A | 10/1945 | Barnett | 34/13 |
| 2,813,318 | A | 11/1957 | Horth | 22/89 |
| 2,988,351 | A | 6/1961 | Barnett et al. | 263/40 |

(List continued on next page.)

FOREIGN PATENT DOCUMENTS

| | | | |
|---|---|---|---|
| CA | 1197981 | 12/1985 | 38/18 |
| DE | 2307773 | 2/1973 | |
| DE | 2310541 | 3/1973 | |
| DE | 2315958 | 4/1974 | B08B/5/00 |
| DE | 2337894 | 11/1974 | B08B/7/04 |
| DE | 2914221 | 4/1979 | |
| DE | 3206048 | 2/1982 | |

(List continued on next page.)

OTHER PUBLICATIONS

Economical Used Energy Type Continuing Heat Treating Furnace For Aluminum Castings Dogyo–Kanetsu vol. 21 No. 2 pp. 29–36—Mar. 1984.

Brochures describing Beardsley & Pipe PNEU–RECLAIM Sand Reclamation Units Prior to Aug. 13, 1992.

Brochure describing Fataluminum Sand Reclamation Units—Prior to Aug. 13, 1992.

(List continued on next page.)

*Primary Examiner*—Gregory Wilson
(74) *Attorney, Agent, or Firm*—Womble Carlyle Sandridge & Rice, PLLC

(57) ABSTRACT

A single furnace system integrates, in combination, two or more distinct heating environments (which in the preferred embodiments include a conduction heating environment and a convection heating environment) integrated such that the multiple environments define a continuous heating chamber through which a moving workpiece (such as a casting) transitions from one heating environment to the other without being exposed to the atmosphere. In accordance with the preferred methods, the transitioning of the casting from one environment to the other is accomplished with no meaningful change in temperature.

25 Claims, 6 Drawing Sheets

U.S. PATENT DOCUMENTS

| | | | | | |
|---|---|---|---|---|---|
| 3,351,687 | A | | 11/1967 | Thome et al. | 264/58 |
| 3,534,946 | A | | 10/1970 | Westerkamp et al. | 263/28 |
| 3,604,695 | A | | 9/1971 | Steeper | 266/5 T |
| 3,737,280 | A | | 6/1973 | Cromp | 432/14 |
| 3,760,800 | A | | 9/1973 | Staffin et al. | 128/24.1 |
| 3,871,438 | A | | 3/1975 | Vissers et al. | 164/5 |
| 3,940,243 | A | * | 2/1976 | Adams | 432/124 |
| 4,068,389 | A | | 1/1978 | Staffin et al. | 34/57 A |
| 4,140,467 | A | | 2/1979 | Ellison et al. | 432/72 |
| 4,161,389 | A | | 7/1979 | Staffin et al. | 432/58 |
| 4,211,274 | A | | 7/1980 | Slowinski et al. | 164/401 |
| 4,242,077 | A | | 12/1980 | Hyre | 431/19 |
| 4,257,767 | A | | 3/1981 | Price | 432/24 |
| 4,294,436 | A | | 10/1981 | Takahashi | 266/257 |
| 4,338,077 | A | | 7/1982 | Shibayama et al. | 432/11 |
| 4,340,433 | A | | 7/1982 | Harding | 148/16 |
| 4,392,814 | A | | 7/1983 | Harding | 431/170 |
| 4,411,709 | A | | 10/1983 | Nakanishi | 148/3 |
| 4,415,444 | A | | 11/1983 | Guptail | 209/3 |
| 4,427,375 | A | | 1/1984 | Di Rosa | 432/58 |
| 4,457,352 | A | | 7/1984 | Scheffer | 164/5 |
| 4,457,788 | A | | 7/1984 | Staffin et al. | 148/20.3 |
| 4,478,572 | A | | 10/1984 | Selli | 432/13 |
| 4,490,107 | A | | 12/1984 | Kimura et al. | 432/11 |
| 4,512,821 | A | | 4/1985 | Staffin et al. | 148/16.5 |
| 4,519,718 | A | | 5/1985 | Staffin et al. | 374/45 |
| 4,524,957 | A | | 6/1985 | Staffin et al. | 266/252 |
| 4,544,013 | A | | 10/1985 | Kearney et al. | 164/5 |
| 4,547,228 | A | | 10/1985 | Girrell et al. | 148/16 |
| 4,577,671 | A | | 3/1986 | Stephan | 164/401 |
| 4,579,319 | A | | 4/1986 | Sasaki | 266/252 |
| 4,582,301 | A | | 4/1986 | Wunning | 266/87 |
| 4,604,055 | A | | 8/1986 | Mackenzie | 432/58 |
| 4,606,529 | A | | 8/1986 | Tooch | 266/80 |
| 4,613,713 | A | | 9/1986 | Staffin et al. | 585/241 |
| 4,620,586 | A | | 11/1986 | Musschoot | 164/253 |
| 4,623,400 | A | | 11/1986 | Japka et al. | 148/6.35 |
| 4,627,814 | A | | 12/1986 | Hattori et al. | 432/128 |
| 4,648,836 | A | | 3/1987 | Thom | 432/107 |
| 4,671,496 | A | | 6/1987 | Girrell et al. | 266/78 |
| 4,681,267 | A | | 7/1987 | Leidel et al. | 241/23 |
| 4,700,766 | A | | 10/1987 | Godderidge | 164/5 |
| 4,779,163 | A | | 10/1988 | Bickford et al. | 361/212 |
| 4,817,920 | A | | 4/1989 | Erfort, Jr. | 266/252 |
| 4,830,605 | A | | 5/1989 | Hodate et al. | 431/170 |
| 4,832,764 | A | | 5/1989 | Merz | 148/131 |
| 4,955,425 | A | | 9/1990 | McKenna | 164/269 |
| 5,018,707 | A | | 5/1991 | Hemsath et al. | 266/254 |
| 5,052,923 | A | | 10/1991 | Peter et al. | 432/205 |
| 5,169,913 | A | | 12/1992 | Staffin et al. | 526/65 |
| 5,239,917 | A | | 8/1993 | Lutkie et al. | 99/443 |
| 5,253,698 | A | | 10/1993 | Keough et al. | 164/269 |
| 5,294,094 | A | | 3/1994 | Crafton et al. | 266/44 |
| 5,306,359 | A | | 4/1994 | Eppeland et al. | 148/511 |
| 5,336,344 | A | | 8/1994 | Wei | 148/549 |
| 5,340,418 | A | | 8/1994 | Wei | 148/549 |
| 5,350,160 | A | | 9/1994 | Crafton et al. | 266/252 |
| 5,354,038 | A | | 10/1994 | Crafton | 266/44 |
| 5,378,434 | A | | 1/1995 | Staffin et al. | 422/141 |
| 5,423,370 | A | | 6/1995 | Bonnemersou et al. | 164/132 |
| 5,439,045 | A | | 8/1995 | Crafton | 164/5 |
| 5,443,383 | A | | 8/1995 | Kuehn | 432/122 |
| 5,485,985 | A | | 1/1996 | Eppeland et al. | 266/87 |
| 5,531,423 | A | | 7/1996 | Crafton et al. | 266/44 |
| 5,536,337 | A | | 7/1996 | Wei | 148/549 |
| 5,551,998 | A | | 9/1996 | Crafton et al. | 148/538 |
| 5,565,046 | A | | 10/1996 | Crafton et al. | 148/538 |
| 5,738,162 | A | | 4/1998 | Crafton | 164/5 |
| 5,829,509 | A | | 11/1998 | Crafton | 164/5 |
| 5,850,866 | A | | 12/1998 | Crafton | 164/5 |
| 6,042,369 | A | | 3/2000 | Bergman et al. | 432/15 |

FOREIGN PATENT DOCUMENTS

| | | | |
|---|---|---|---|
| DE | 4012158 | 11/1990 | 164/5 |
| DE | 195 30 975 | 2/1997 | B22C/5/00 |
| EP | 0 546 210 | 6/1993 | B22D/29/00 |
| EP | 1 010 484 A2 | 6/2000 | B22D/29/00 |
| FR | 7043571 | 12/1970 | |
| FR | 2 448 573 | 2/1979 | C21D/9/00 |
| GB | 1392405 | 4/1975 | |
| GB | 1564151 | 4/1980 | |
| GB | 1569152 | 6/1980 | |
| GB | 2187398 | 9/1987 | F27B/15/09 |
| GB | 2230720 | 10/1990 | B22O/29/00 |
| GB | 2137114 | 10/1994 | B01J/268/36 |
| JP | 5653867 | 5/1981 | |
| JP | 5939464 | 8/1982 | |
| JP | 5825860 | 2/1983 | |
| JP | 59219410 | 12/1984 | |
| JP | 6092040 | 5/1985 | 164/132 |
| JP | 2074022 | 9/1985 | |
| JP | 6316853 | 1/1988 | 164/132 |
| JP | 63108941 | 5/1988 | |
| JP | 2104164 | 8/1990 | |
| JP | 62110248 | 5/1997 | |
| RU | 1129012 | 7/1982 | |
| RU | 0234810 | 3/1985 | 164/132 |
| WO | WO 97/30805 | 8/1997 | |
| WO | WO 98/14291 | 4/1998 | |
| WO | WO 00/36354 | 6/2000 | |

OTHER PUBLICATIONS

Paul M. Crafton—Heat Treating Aging System Also Permits Core Sand Removal—Reprinted from 09/89 Modern Castings magazine.

Sales brochure describing Thermfire Brand Sand Reclamation, Gudgeon Bros., Ltd. believed to be known to others prior to 09/89.

Sales brochure describing Simplicity/Richards Gas–Fired Thermal Reclamation System Simplicity Engineering, Inc. — believed to be known to others prior to 09/89.

Sales brochure describing AirTrac Brand Fluidizing Conveyor, Air Trac Systems Corp., believed to be known to others prior to 09/89.

Sales brochure describing Fluid Bed Calcifer Thermal Sand Reclamation Systems, Dependable Foundry Equipment Co.—Believed to be known to others prior to 09/89.

* cited by examiner

COMBINATION CONDUCTION/ CONVECTION FURNACE

CROSS-REFERENCE TO RELATED APPLICATIONS

This application is a continuation of Ser. No 09/464,229 filed Dec. 15, 1999, U.S. Pat. No. 6,336,809 which is a continuation-in-part of U.S. application Ser. No. 09/313,111, filed May 17, 1999 now U.S. Pat. No. 6,217,317.

This application also claims the benefit of U.S. provisional application serial No. 60/112,400, filed Dec. 15, 1998.

BACKGROUND OF THE INVENTION

The present invention relates generally to the field of foundry processing, and more particularly to heat treating metal castings and reclaiming sand from sand cores and sand molds used in the manufacture of metal castings.

Many changes have been made in the field of heat treating of metal castings and reclaiming sand from sand cores and sand molds used in the manufacture of metal castings. Examples of some recent disclosures which address the heat treating of castings, removal of sand cores, and further reclaiming of sand are found in U.S. Pat. Nos. 5,294,094, 5,354,038, 5,423,370, and 5,829,509 (hereinafter sometimes referred to collectively as the "Reference Patents"), each of which is expressly incorporated herein by reference, in their entirety. Those patents disclose a three-in-one process/ integrated system that (i) receives and heat treats a casting, (ii) removes sand core/sand mold materials from the casting, and (iii) reclaims sand from the sand core/sand mold materials removed from the casting; the '094 and '038 patents embodying a convection furnace species, the '370 patent embodying a conduction furnace species, and the '509 patent alternately embodying either a conduction furnace species or a convection furnace species (and adding an integrated cooling chamber). The sand core/sand mold materials (referred to hereafter as sand core materials) comprise sand that is held together by a binder material such as, but not limited to, a combustible organic resin binder.

Technology such as that disclosed in the above-mentioned patents are driven, for example, by: competition; increasing costs of raw materials, energy, labor, and waste disposal; and environmental regulations. Those factors continue to mandate improvements in the field of heat treating and sand reclamation.

SUMMARY OF THE INVENTION

Briefly described, the present invention provides a single furnace system which integrates, in combination, a plurality of distinct heating environments (which in the preferred embodiments include two heating environments comprising a conduction heating environment and a convection heating environment) integrated such that the plurality of environments define a continuous heating chamber through which a moving workpiece (such as a casting) transitions from one heating environment to the other without being exposed to the atmosphere. In accordance with the preferred methods, the transitioning of the casting from one environment to the other is accomplished with no meaningful change in temperature.

In accordance with a second aspect of the invention, improved species embodiments of a 3-in-1 processing system of the genus described in the above identified prior patent specifications are provided. These species embodiments of the present invention disclose a system apparatus and method for processing a casting which perform the integrated processes of core removal, sand reclaiming and heat treatment in a combination conduction and convection furnace system.

Other objects, features, and advantages of the present invention will become apparent upon reading and understanding this specification, taken in conjunction with the accompanying drawings.

DETAILED DESCRIPTION OF THE DRAWINGS

Figure 1:
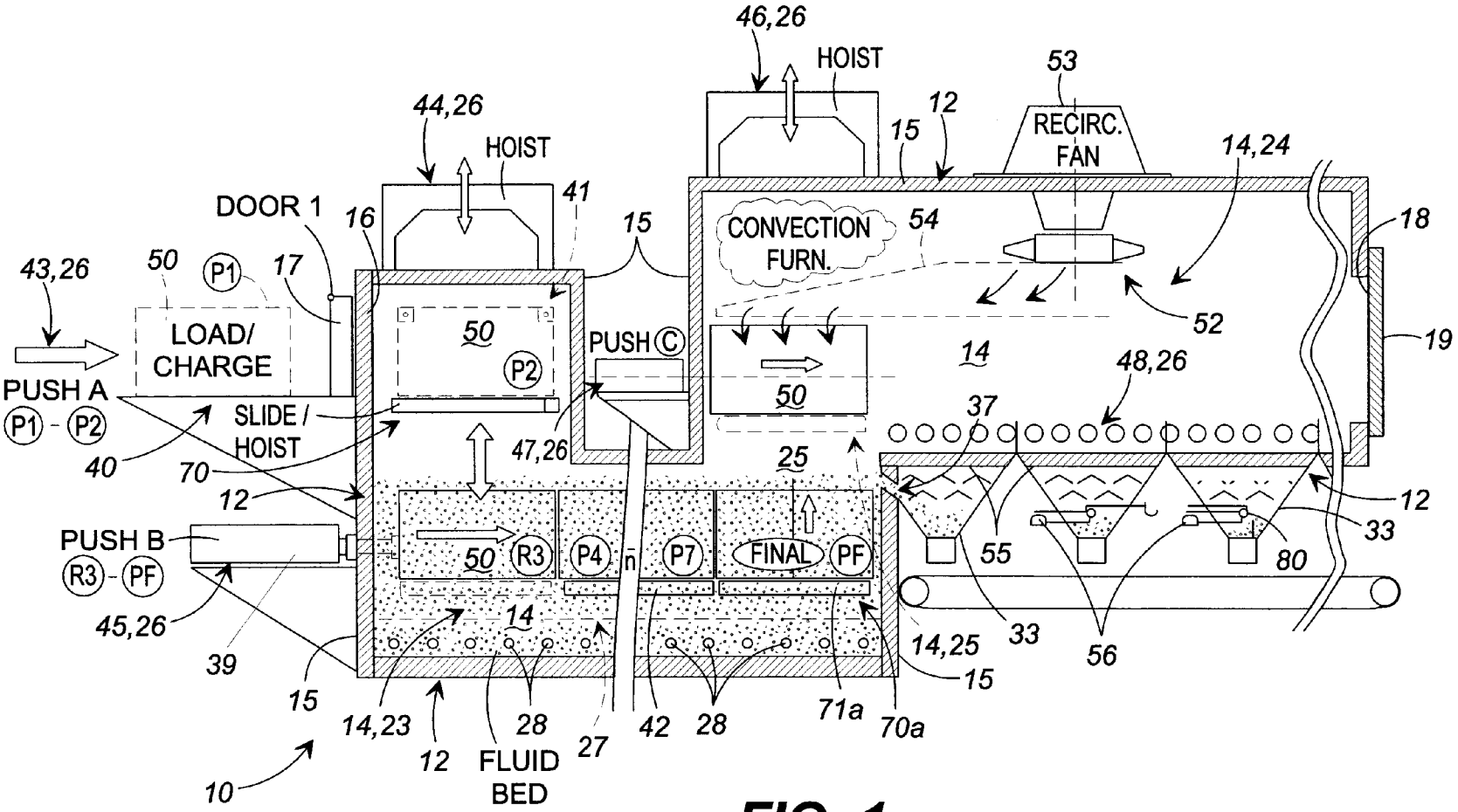
FIG. 1 is a schematic, side cut-away view of a combination conduction/convection furnace, in accordance with the preferred embodiment of the present invention.

Referring now to the drawings in which like numerals represent like components throughout the several views, FIG. 1 depicts in schematic representation a combination conduction/convection furnace 10 in accordance with a preferred embodiment of the present invention. The combination furnace 10 is seen as comprising a frame structure 12 which defines an enclosed heating chamber 14 and includes insulated walls 15 surrounding the heating chamber, an entrance portal 16 outfitted with a selectively closable insulated inlet door 17 and an exit portal 18 outfitted with a selectively closable insulated outlet door 19. The heating chamber 14 is seen as divided into two major heating chamber segments 23, 24 which together comprise the continuous heating chamber 14 and are interconnected by a transitional passage 25. In accordance with the preferred embodiments of the present invention, the transitional passage 25 is of sufficient size and orientation to allow for the easy movement from the first heating chamber segment 23 to the second heating chamber segment 24 of a work piece, such as a casting, as well as the free movement of heat, gases, dust, and the like from one chamber segment to the other chamber segment. An integrated transportation system 26 transports the castings from the entrance portal 16, through the first heating chamber 23, into and through the second heating chamber 24, to the exit portal 18.

In accordance with the preferred embodiments of the present invention, each of the first heating chamber segment 23 and second heating chamber segment 24 is equipped to heat a casting within the respective chamber segment by a furnace heating process which is of a process distinct from the furnace heating process with which the other chamber segment is equipped.

Figure 2:
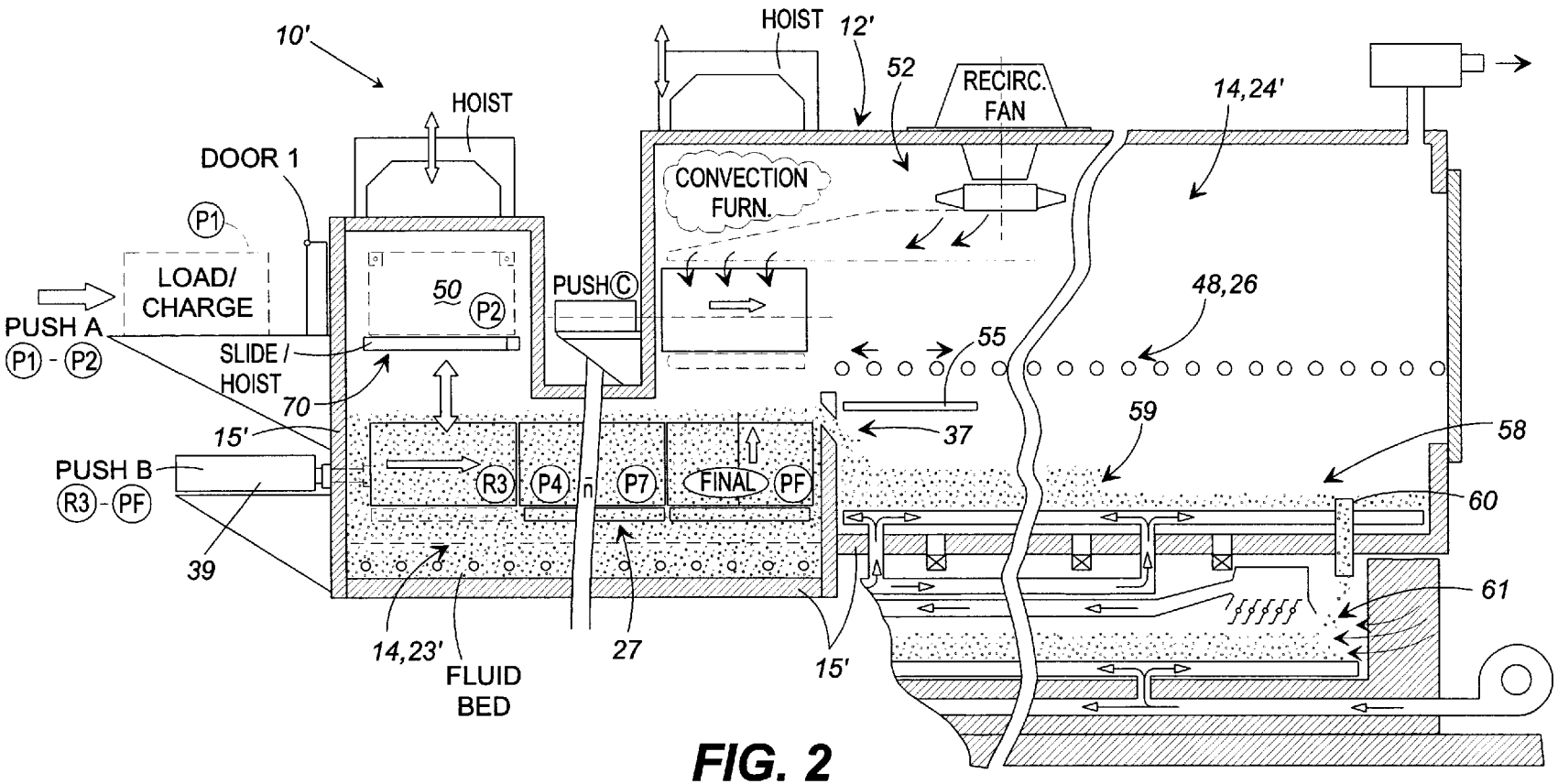
FIG. 2 is a schematic, side cut-away view of a combination conduction/convection furnace, in accordance with an alternate embodiment of the present invention.
Figure 3:
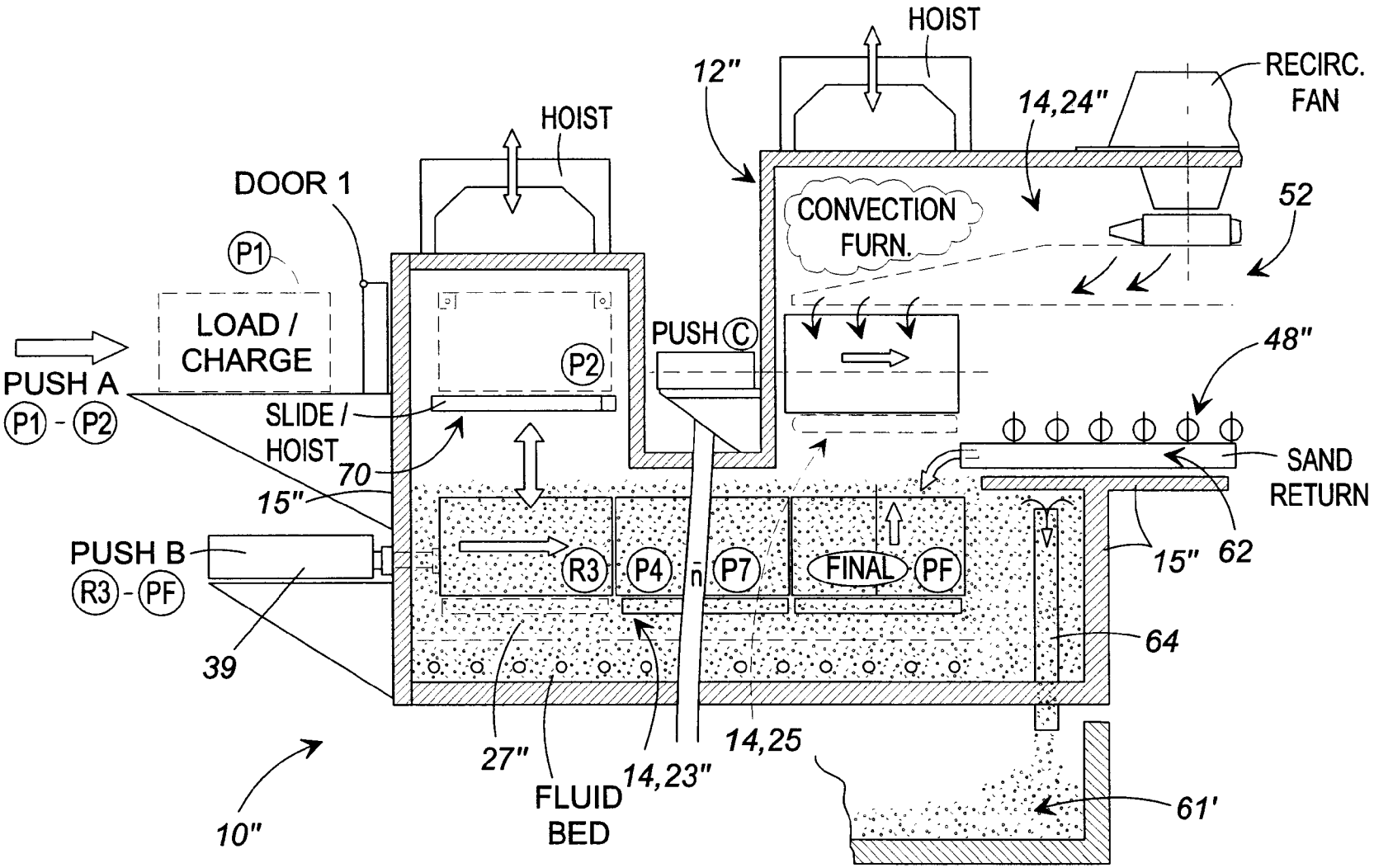
FIG. 3 is a schematic, side cut-away view of a combination conduction/convection furnace, in accordance with a second alternate embodiment of the present invention.

The herein depicted, preferred embodiments of FIGS. 1–3 are equipped with a conduction furnace heating process, in the form of a fluidized bed furnace, in the first heating chamber segment 23 and are equipped with a convection type heating furnace in the second heating chamber segment 24. The heating environment provided in the first heating chamber segment 23 is, thus, an environment as is created by a conduction type furnace (such as a fluidized bed furnace) and the heating environment of the second heating chamber segment 24 is, thus, an environment as is created by a convection type furnace. As depicted in the drawings, a bed 27 of particles (the fluidizing medium) mostly fills the first heating chamber segment 23, and conduit 28 for the introduction of fluidizing gases are provided. A heating source (not shown) provides heated fluidizing gases to the conduit 28. In this heating chamber segment 23, castings are immersed within the fluidized bed 27 where heat is transferred to the castings from surrounding heated bed particles by conduction, and where the castings are heated to an appropriate temperature for an appropriate period of time to accomplish one or more (full or partial) desired casting processing steps (an example of which is expressed below). The convection heating chamber segment 24 includes heating sources (not shown) which heat the air inside the heating chamber segment such that the heat transfers by convection to a casting contained within the convection heating chamber segment and such that the castings are heated to an appropriate temperature for an appropriate period of time to accomplish one or more (full or partial) desired casting processing steps (an example of which is expressed below).

Figure 1A:
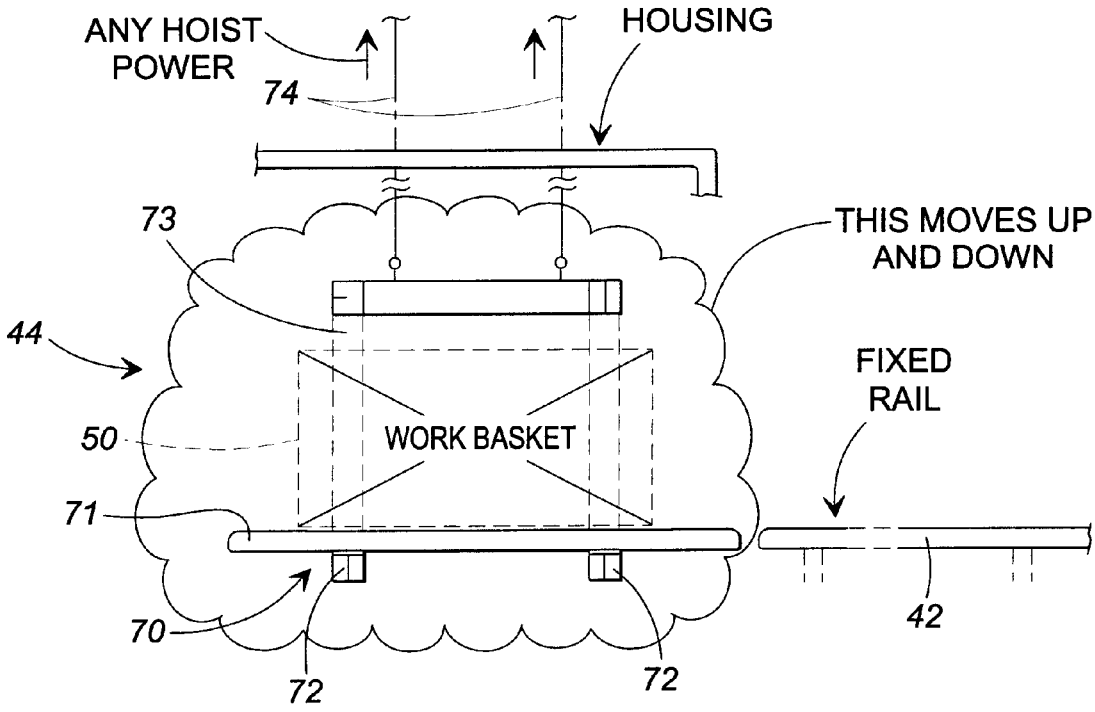
FIG. 1A is an isolated view of hoist and rail components of one embodiment of a transport system utilized in the furnace of the present invention.

Referring again, generally, to FIG. 1 (and FIGS. 2 and 3), the combination furnace 10 is seen as also including a loading station 40 outside the furnace structure 12 and, an entry zone 41 inside the furnace structure 12. The entry zone 41, of the herein depicted embodiments of FIGS. 1 and 2, occupies a portion of the heating chamber 14 positioned above the fluidized bed segment 23 and receives rising heat, thus exposing castings in the entry zone to initial chamber heat. The integrated transport system 26, of the herein depicted embodiments is comprised of a combination of a charge transport mechanism (depicted by arrow 43) and entry transport mechanism 44 (depicted in FIG. 1, for example, as a hoist), a first chamber transport mechanism 45 (depicted in FIG. 1, for example, as a ram/push device 39 and including an elongated fixed rail assembly 42 (see FIG. 1A)), a transitional transport mechanism 46 (depicted in FIG. 1 as, for example, another hoist mechanism), a second transitional transport mechanism 47 (depicted herein as, for example, a ram/push device), and a second chamber transport mechanism 48 (depicted as, for example, a roller conveyor). With reference to FIG. 1A, an example of a hoist type entry transport mechanism 44 is depicted, together with a representative fixed rail assembly 42 of the first chamber transport mechanism 45. The entry transport mechanism 44 includes a movable pallet 70 (formed of two spaced apart lateral rails 71 (one shown) and two, spaced apart transverse beams 72) and a four cornered support frame 73 supported from above by cabling 74 connected to a drive mechanism (not shown). A hoist type first transition transport mechanism 46 is of similar construction. The construction and operation of the depicted integrated transport system 26 is deemed readily understood by those skilled in the art upon reference to this specification. Movement of the casting through the various chambers is not limited to those particular mechanisms depicted herein and alternate transporting mechanisms will be apparent to those skilled in the art.

In a first preferred embodiment, as depicted in FIG. 1, the convection heating chamber segment 24 is comprised of an upper open air portion through which the casting moves and is heated and a lower portion formed, for example, as a hopper (or hoppers) 33 into which falls and is collected (and, preferably, is further processed) any sand core materials which may fall from the casting in this segment of the heating chamber. In the embodiment of FIG. 1, the convection segment 24 is shown outfitted with an air re-circulating system 52 which stirs air within the convection heating chamber segment 24 to assist in acquiring temperature uniformity, throughout the convection heating chamber segment (including at the vicinity of the transitional passage 25), as would be understood by those skilled in the art. The herein depicted recirculating system includes a re-circulating fan 53 and related ductwork 54, though other re-circulating systems will be readily identified by those skilled in the art. In the embodiment of FIG. 1, the convection segment 24 is provided with sand reclaiming features such as screens 55 and in-hopper fluidization 56. The structure and operation of these reclaiming features will be understood by reference to the Reference Patents, especially U.S. Pat. Nos. 5,294,094 and 5,345,038. In the alternate embodiment of the combination furnace 10' of FIG. 2, the convection segment 24' includes a furnace chamber with a trough 58 with fluidized, migrating bed 59, discharge weir 60, and integrated cooling chamber 61 similar to the embodiment of FIG. 1A of Reference Patent U.S. Pat. Nos. 5,829,509, and the structure and operation of the furnace chamber segment 24' and related reclaiming will be understood by reference to that Patent. The embodiments of FIGS. 1 and 2 are also seen as including a weir or spillway 37 by which sand or other particles accumulating within the fluidized bed furnace is allowed to spill into the hopper 33 or trough 58, respectively, of the convection chamber 24, 24', thus controlling the depth of the bed 27 of the fluidized bed segment 23, and, preferably, controlling the dwell time of any sand core particles within the fluidized bed 27.

Each of the conduction heating segment 23 and the convection heating segment 24, 24' of the depicted embodiments will have additional structure and will operate in a manner all of which will be clearly understood by those skilled in the art after review of this entire specification, aided with reference to the specifications of the "Reference Patents" cited previously herein. As such, no further description is deemed necessary to enable the functionality mentioned throughout this specification.

In operation, and in accordance with one preferred method of the present invention, a casting (not seen), typically laden with outer molds and/or inner sand cores (collectively referred to herein as "sand cores") is positioned at the loading station 40 ("P1"). The casting is, for example, carried within a wire basket or like transport container 50 which contains the casting yet allows for access to the casting by the fluidizing medium of the bed 27 and also allows for the discharge from the container of sand core material which falls from the casting. The basket and casting are moved, for example, by being pushed by the charge transport mechanism 43 through the temporarily open inlet door 17 to the entry segment 41 (at position "P2"), where the basket rests on, for example, a hoist pallet 70. The entry transport mechanism 44 lowers the pallet 70 with the basket 50 and casting into the conduction heating chamber segment 23 until the casting is fully immersed within the fluidized bed 27 and the lateral rails 71 align with the fixed rails 42. The fluidized bed 27 is, preferably, comprised of refinery sand similar in nature to that sand of which the sand cores of the casting are created. Preferably, the fluidized bed has been preheated to an initial temperature prior to receiving the casting. The fluidized bed 27 is heated to a temperature sufficient to perform the particular casting processing steps desired to be carried out within the fluidized bed. For example, the bed 27 is heated to a temperature sufficient enough to conduct heat to the casting of a temperature sufficient to dislodged sand core materials from cavities within castings. The core materials preferably comprise sand that is bound by a thermally degradable material such as, but not limited to, an organic resin binder. Thus, in at least the preferred embodiments, the fluidized bed is heated to above the combustion temperature of the organic resin binder. In preferred embodiments, the processing steps desired to be performed in the fluidized bed segment 23 are, at least, the process of removing sand cores from the casting and the process of reclaiming sand from the core material which exits the castings while in the fluidized bed furnace. To that end, the techniques of heating the sand core to a sufficiently high temperature as well as the techniques of retaining the discharged sand core within the fluidized bed 27 for sufficient dwell time to substantially reclaim the sand are employed as would be understood by those skilled in the art, especially with reference to the "Reference Patents". It is not required that all moldings and sand core be removed from the casting in the fluidized bed since a certain amount of core removal and sand reclamation is provided for and acceptable within the convection segment 24, though in preferred embodiments a meaningful amount of core removal and sand reclamation is preferred within the conduction segment 23. A certain amount of heat treatment of the casting within the fluidized bed heating chamber segment 23 is anticipated.

During the time that the casting is immersed within the fluidized bed, basket 50, with the casting, is moved by the first chamber transport mechanism 45 longitudinally through the conduction heating chamber segment 23 from its entry position at "P3" to a final bed position "PE" adjacent the convection heating chamber segment 24. Various techniques understood in the art are acceptably used for moving the basket 50 and casting through the fluidized bed, including, for example, the ram/push device 39 and rail assembly 42 depicted. The push device 39, in the exemplary embodiments, pushes the basket 50 laterally off the rails 71 of the movable pallet 70 onto the fixed rails 42, through the fluidized bed chamber segment 23, to a resting position on the rails 71*a* of the movable pallet 70*a* of the first transitional transport mechanism 46 (position PF). From position PF, the movable pallet 70*a,* with the basket 50 and casting, is raised by the transitional transport mechanism 46 (for example, by a hoist) through the transitional passage 25 to a position in the convection heating chamber segment 24 adjacent the second chamber transport mechanism 48. From this position the basket 50 is moved longitudinally off the pallet rails 71*a* and then through the convection heating chamber segment 24, first by the second transitional transport mechanism 47 and then by the second chamber transport mechanism 48. Again, movement of the casting through the various chambers is not limited to those particular mechanisms depicted herein and alternate transporting mechanisms will be apparent to those skilled in the art. For example, in one embodiment (not shown) the casting is acceptably transported through the entire chamber 14 by a basket supported overhead by a cable extending from a shuttle moving longitudinally over the frame structure 12 on an overhead rail. The shuttle selectively spools and unspools the cable to raise and lower the basket at appropriate times.

It is the intention of the present invention that heat generated in the conduction heating chamber segment 23 will pass freely through the transitional passage 25 into the convection heating chamber segment 24 and, thereby, provide preheat to the convection segment and assist in effecting a continuing casting heating process from the conduction heating environment to the convection heating environment without meaningful change in temperature. As the casting is moved through the convection heating chamber segment 24, the chamber segment is heated to sufficient temperature to perform the casting processing steps desired for this chamber segment. For example, preferably, heat treatment of the casting is performed and completed during the casting's containment within the convection heating chamber segment 24.

Simultaneously with the heat treating, it is desired that any remaining sand core is removed from the casting and the sand is substantially reclaimed from the remaining sand core portions. Accordingly, for assisting in removal of any remaining sand of the core of the casting, hot air can be directed toward the casting in one or more directions so as to bombard the casting on different sides as the casting is moved through the convection heating chamber segment to remove any remaining sand out of the casting. Alternatively or in conjunction with the application of hot air against the casting, the casting further can be quenched by directing air toward the casting in one or more directions. This quenching air tends to cool down the casting and force any remaining sand of the core out of the casting. Any sand that is removed from the casting in such a manner will tend to fall through the second chamber transport mechanism 48 for collection by the reclaiming sand hoppers 33. Further, as the casting is moved through convection heating chamber segment 24 toward the exit portal 18, the castings can further be subjected to a vibrating mechanism or other similar mechanism that vibrates or shakes the castings to further assist in the removal of any remaining sand from the castings. Any remaining sand removed or vibrated out of the castings will be collected in the reclaiming sand hoppers 33 for reclamation and discharge. It is possible that any of these steps of applying hot air, applying cool air to quench the casting, and/or vibrating the casting as it is moved through the convection heating chamber segment 24 can be used separately or in conjunction with the heating and reclamation process of the invention to further assist in removal of any remaining sand of the sand core from the castings. Upon completion of the appropriate processing, the basket and casting are conveyed out of the exit portal 18.

FIG. 2 depicts a third embodiment of the combination furnace 10" which does not include a hopper or a trough for retention of fallen sand core materials but, rather, includes a sand return 60 by which sand core collected in the convection heating segment 24" is conveyed back to the fluidized bed segment 23 where it is further processed for reclaiming of sand. A discharge weir 64 within the fluidized bed segment 23" is provided in order to discharge reclaimed sand from the fluidized bed segment, and the depth of the bed 27 is established or regulated to provide proper dwell time for reclamation. The weir 64 acceptably discharges to a cooling chamber 61' as will be understood by reference to the embodiment of FIG. 113 of the U.S. Pat. No. 5,829,509.

In accordance with the most preferred methods of the present invention, the combination furnace 10 is utilized to perform the three-in-one processes of casting processing known as core removal, in furnace sand reclamation, and heat treatment. However, it should be understood that the combination furnace 10 of the present invention is acceptably utilized to perform one or more of the mentioned processes or other processes associated with the processing of castings using heat. In alternate embodiments where it is planned that no core removal will take place within the combination furnace (for example, when all sand core molds are removed, perhaps by vibration techniques, prior to delivery of the casting to the furnace), then the sand reclaiming features of the furnace, such as, the spillway 37, screens 55, and fluidizers 56 are acceptably removed.

The present invention is seen as relating to the integration of a plurality of (two or more) heating environments in such a manner as to effect a continuous heating chamber, and, in accordance with the present invention, at least two adjacent heating environments within the continuous heating chamber are distinct from one another. In the herein described embodiment, the distinct environments are disclosed as one being a fluidized bed conduction furnace and the other a convection furnace.

Figure 4:
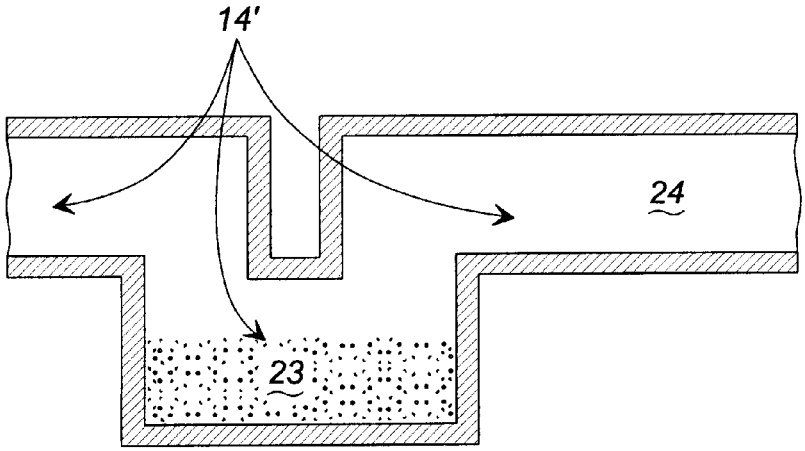
FIGS. 4–6 are schematic, side cut-away views of alternate embodiments of multiple heating environments comprising an integrated continuous heating chamber of a furnace system in accordance with the present invention.
Figure 6:
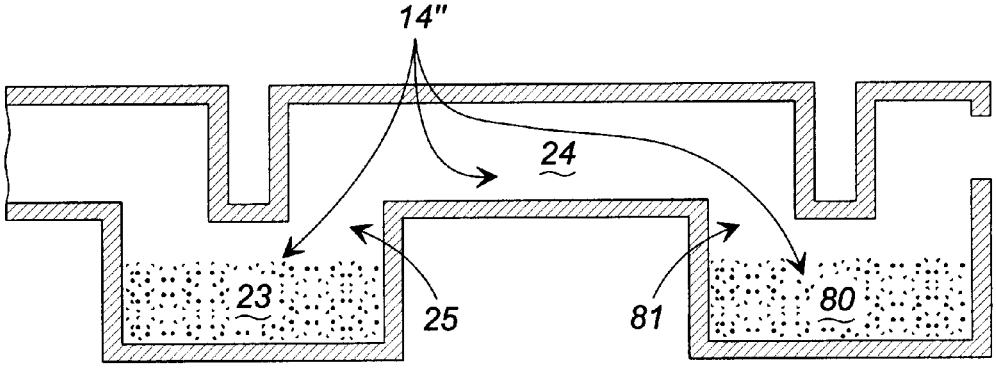

It is clear and understood that the combination heating environment expressed in FIGS. 1–3 herein is acceptably two segments of a larger heating chamber comprised of other heating chamber segments, including other heating environments. Such an expanded heating chamber 14', 14" is schematically represented in FIGS. 4 and 6. For example, in one alternate embodiment (see FIG. 6), another segment 80 comprising a fluidized bed furnace type of heating environment follows the convection segment 24 of FIG. 1. Following the spirit of the present invention, in such embodiment, a heat channeling transitional zone 81 is provided between the convection segment 24 and the additional conduction heating chamber segment 80 of FIG. 6.

By way of further example, in another embodiment (not specifically shown, but inferentially seen in FIG. 4), a convection type heating segment is added to the front of the fluidized bed conduction segment 23 of FIG. 1, with a heat channeling transitional zone in between. In still other embodiments (not shown), a duplicate of the combination fluidized bed and convection system of FIG. 1 is "piggy-backed" to the front or back (or both) of the system shown in FIG. 1. In such latter embodiments, the invention again includes a heat channeling transitional zone provided between each adjacent heating environment segment.

Figure 5:
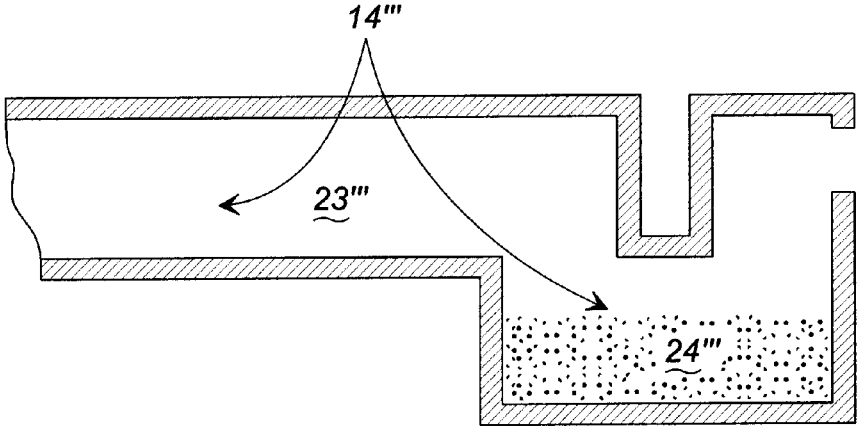

Furthermore, the present invention is not limited by the order of the respective heating environments. Rather, for example (as schematically represented by FIG. 5), should a particular processing technique favor the placement of a convection heating environment prior to a fluidized bed conduction environment, then the order of the heating environments as shown in FIG. 1 is acceptably reversed. FIG. 5 schematically shows a convection heating environment as the first heating segment 23''' and a fluidized bed conduction environment as the second heating segment 24'''.

Figure 7:
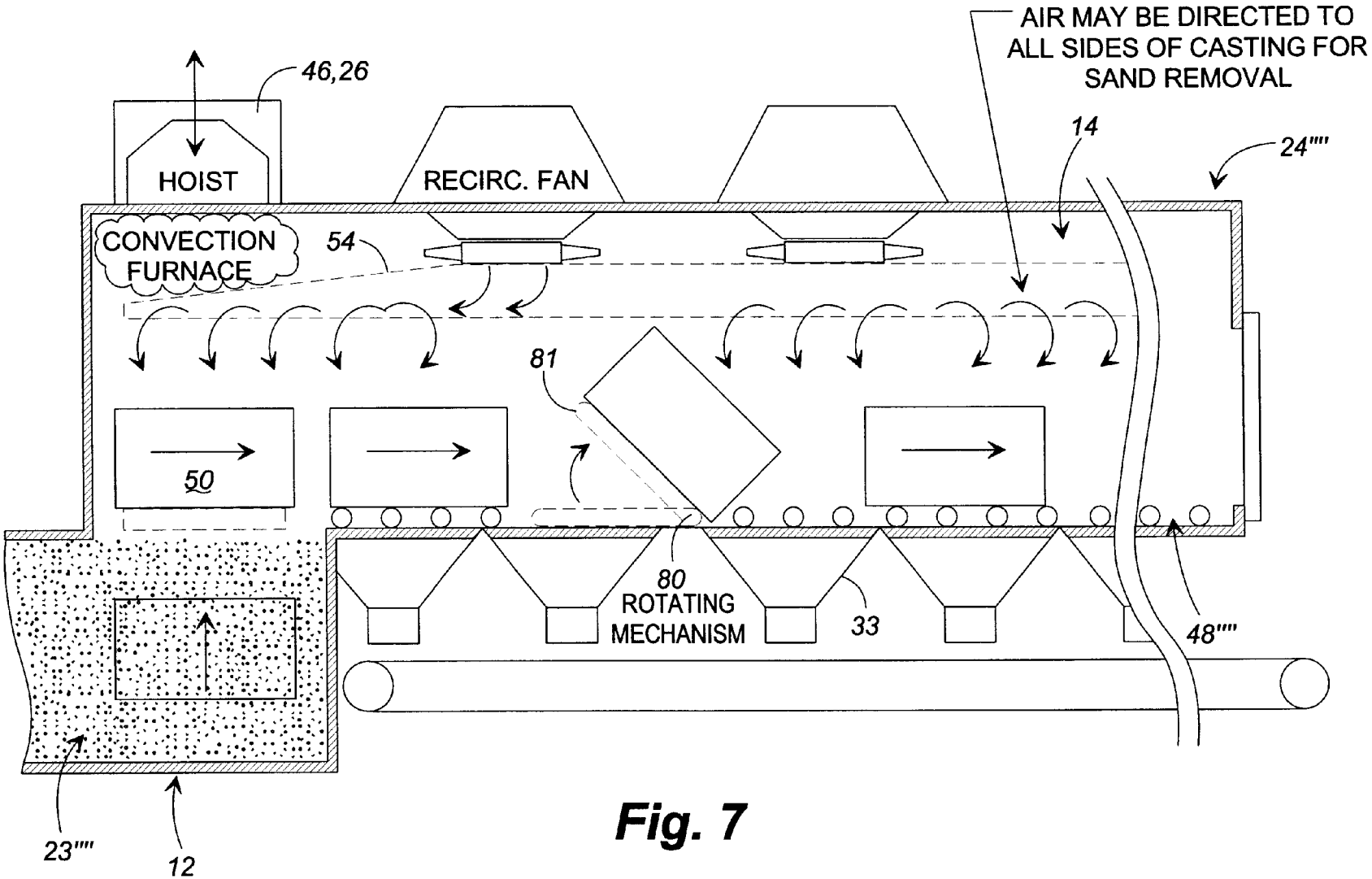
FIG. 7 is a schematic side cut away view of an alternate embodiment of the convection heating segment including a casting rotary mechanism.

As illustrated in FIG. 7, in a further alternative embodiment of the second, convection heating segment 24'''', a rotating mechanism 80 is provided along the second chamber transport mechanism 48'''', positioned at an intermediate point along the length of the second heating chamber segment 24''''. The rotating mechanism can comprise a pair of pivoting rails, such as indicated by dashed lines 81, or similar mechanism to engage and lift the castings, so as to cause the castings to be reoriented on the transport mechanism 48'''' as illustrated in FIG. 7. The reorienting of the casting on the transport mechanism helps to enable a higher percentage of sand to be dislodged or shaken loose and thus removed from the castings so as to be collected in the sand reclamation hoppers. The rotating mechanism 80 can further be used separately or in conjunction with a further application of hot air or cooling air being directed against the castings from one or more directions in order to heat or quench the castings to further assist in the removal of sand from castings, or in conjunction with the vibrating mechanism, as discussed above, so as to further insure a substantially complete removal of sand from the sand cores from within the castings.

Whereas the disclosed embodiments have been explained using the fluidized bed conduction heating environment and the convection furnace heating environment as adjacent heating environments, it is clearly within the scope of the invention to incorporate any distinct heating environments as the at least two adjacent distinct heating environments. Such heating environments might acceptably include any heating environment known and understood currently or in the future by those skilled in the art, including, without limitation, conduction, convection, and radiant heating environments.

While the embodiments which have been disclosed herein are the preferred forms, other embodiments will suggest themselves to persons skilled in the art in view of this disclosure and without departing from the spirit and scope of the claims.

What is claimed is:

1. A furnace system comprising:

a heating chamber including a plurality of distinct heating environments interconnected by a passage through which a workpiece transitions from one distinct heating environment to another without said workpiece exhibiting a meaningful drop in temperature, further including a rotating mechanism disposed within the heating chamber for reorienting a workpiece therein, wherein the rotating mechanism includes a pair of pivoting rails.

2. A furnace system comprising:

a plurality of distinct heating environments interconnected by a passage through which a transport mechanism is movably disposed, wherein at least one of the heating environments includes a conduction furnace; and, a rotating mechanism cooperating with said transport system.

3. A furnace system comprising:

a plurality of distinct heating environments interconnected by a passage through which a transport mechanism is movably disposed, wherein at least one of the heating environments includes a fluidized bed; and, a rotating mechanism cooperating with said transport system.

4. A furnace system comprising:

a plurality of distinct heating environments interconnected by a passage through which a transport mechanism is movably disposed; and, a rotating mechanism cooperating with said transport system, wherein the rotating mechanism includes a pair of pivoting rails.

5. A furnace system comprising:

a heating chamber including a plurality of distinct heating environments and a transport mechanism for transitioning a workpiece through said distinct heating environments, wherein at least one of the heating environments includes a conduction furnace; and, a rotating mechanism cooperating with said transport mechanism for reorienting a workpiece within the heating chamber.

6. A furnace system comprising:

a heating chamber including a plurality of distinct heating environments and a transport mechanism for transitioning a workpiece through said distinct heating environments, wherein at least one of the heating environments includes a fluidized bed; and, a rotating mechanism cooperating with said transport mechanism for reorienting a workpiece within the heating chamber.

7. A furnace system comprising:

a heating chamber including a plurality of distinct heating environments and a transport mechanism for transitioning a workpiece through said distinct heating environments; and, a rotating mechanism cooperating with said transport mechanism for reorienting a workpiece within the heating chamber, wherein the rotating mechanism includes a pair of pivoting rails.

8. A method for heat treating a casting comprising:

moving the casting through a heating chamber having distinct heating environments;

heating the casting in one of the distinct heating environments;

moving the casting from one of the distinct heating environments to another of the distinct heating environments;

rotating the casting in the heating chamber; and, heating the casting at an entry zone to the heating chamber.

9. A method for heat treating a casting comprising:

moving the casting through a heating chamber having distinct heating environments;

heating the casting in one of the distinct heating environments;

moving the casting from one of the distinct heating environments to another of the distinct heating environments;

rotating the casting in the heating chamber; and, reclaiming sand from the dislodged portions of the core.

10. The method of claim 9, further including heating the passage with heat from the distinct heating environments.

11. A method for heat treating a casting comprising:

moving the casting through a heating chamber having distinct heating environments;

heating the casting in one of the distinct heating environments;

moving the casting from one of the distinct heating environments to another of the distinct heating environments;

rotating the casting in the heating chamber; and, collecting the dislodged sand from the castings.

12. A method for heat treating a casting comprising:

moving the casting through a heating chamber having distinct heating environments;

heating the casting in one of the distinct heating environments;

moving the casting from one of the distinct heating environments to another of the distinct heating environments;

rotating the casting in the heating chamber; and, heating dislodged sand to a temperature sufficient to reclaim the sand.

13. A method for heat treating a casting comprising:

moving the casting through a heating chamber having distinct heating environments;

heating the casting in one of the distinct heating environments;

moving the casting from one of the distinct heating environments to another of the distinct heating environments; and, rotating the casting in the heating chamber, wherein the casting is rotated about a horizontal axis.

14. A furnace system comprising:

a plurality of separately temperature-controlled heating environments integrated such that the heating environments define a continuous heating chamber through which a moving workpiece transitions from one heating environment to another with no meaningful change in temperature, wherein at least one heating environment of said heating environments comprises a fluidized bed in which the workpiece is received for heating.

15. The furnace system of claim 14, wherein one of said heating environments comprises a conduction furnace.

16. The furnace system of claim 15, wherein said conduction furnace includes the fluidized bed.

17. The furnace system of claim 14, wherein one of said heating environments comprises a convection furnace.

18. The furnace system of claim14, wherein a transitional passage is defined between the heating environments to enable movement of the workpiece and heat between the heating environments.

19. The furnace system of claim 14, further comprising a transport system extending through said heating environments.

20. The furnace system of claim 19, wherein said transport system comprises an entry transport mechanism, a first chamber transport mechanism positioned within a first one of said heating environments, a transitional transport mechanism, and a second chamber transport mechanism extending through a second one of said heating environments.

21. A method of processing castings and reclaiming sand from sand cores and molds found in the castings, comprising:

moving the castings through a heating chamber having a plurality of heating environments wherein at least one heating environment of said heating environments comprises a fluidized bed in which a workpiece is received for heating;

heating the castings within a first heating environment of the heating chamber at a first temperature sufficient to dislodge at least a portion of the sand core from the castings;

moving the castings from the first heating environment to a second heating environment of the heating chamber without a meaningful change in temperature;

heat treating the castings within the second heating environment of the heating chamber; and, separately controlling the temperature in each heating environment.

22. The method of claim 21, further comprising initially exposing the castings to heat at an entry zone for the heating chamber.

23. The method of claim 21, further comprising heating the dislodged core portions within the first heating environment at a temperature and for a dwell time sufficient to reclaim sand from the dislodged sand portions.

24. The method of claim 21, further comprising preheating the second heating environment with heat from the first heating environment to effect a continuation of the heating of the castings with no meaningful change in temperature.

25. The method of claim 21, wherein the step of moving the castings through the heating chamber comprises placing the castings in transport containers and conveying the transport conveyors through a first and a second heating environments of the heating chamber.

* * * * *